United States Patent [19]

Trost

[11] 4,170,249

[45] Oct. 9, 1979

[54] WARP LENGTH COMPENSATOR FOR A TRIAXIAL WEAVING MACHINE

[75] Inventor: Wayne C. Trost, Rockford, Ill.

[73] Assignee: Barber-Colman Company, Rockford, Ill.

[21] Appl. No.: 945,758

[22] Filed: Sep. 25, 1978

[51] Int. Cl.[2] ..... D03D 41/00

[52] U.S. Cl. ..... 139/11; 139/DIG. 1

[58] Field of Search ..... 139/11, DIG. 1, 13, 139/15, 16, 17, 97

[56] References Cited

U.S. PATENT DOCUMENTS

| | | | |
|---|---|---|---|
| 4,020,876 | 5/1977 | Townsend et al. | 139/97 |
| 4,036,262 | 7/1977 | Darsie et al. | 139/11 |

*Primary Examiner*—Henry Jaudon

*Attorney, Agent, or Firm*—A. Richard Koch

[57] ABSTRACT

A fixed cam located between a circular yarn guide and a continuous line of yarn separators moving around a substantially linear closed path is shaped to maintain substantially constant the length of warp strands moved laterally between the circular yarn guide and any of the yarn separators.

9 Claims, 12 Drawing Figures

WARP LENGTH COMPENSATOR FOR A TRIAXIAL WEAVING MACHINE

BACKGROUND OF THE INVENTION

In triaxial weaving machines the warp strands in the two sheets of warp strands forming alternate sheds must cross in order to produce triaxial fabric. One means for accomplishing such crossing is to supply the warp strands from a creel continuously rotating in one direction in timed relation to the weftwise shifting of the warp strands. In order to prevent different tensions in the warp strands during a revolution of the creel, means must be provided to maintain a substantially constant length of each warp strand between the creel and the weaving mechanism. Prior methods and apparatus for accomplishing this result are disclosed in U.S. Pat. No. 4,036,262, issued on July 19, 1977 to Burns Darsie and Richard A. Schewe, and U.S. Pat. No. 4,020,876, issued on May 3, 1977 to Franklin L. Townsend and Robert L. Govig. Neither of these inventions were completely satisfactory solutions to the problem. In the latter the friction between the warp strands and the flexible guides was too great, creating a drag that prevented effective use of dropwires to detect broken or exhausted strands. Difficulties were encountered with knots, slubs and the like entering and passing through the guides. When more than one warp strand passed through the same guide, they often became twisted or entangled. In the former invention difficulties resulted from cocking of the block means and attempts to retain the yarn between the divider plates during threading. Too much friction resulted from the yarn passing over a plurality of surfaces involving substantial changes in direction, resulting in relatively long engagements.

SUMMARY OF THE INVENTION

According to the present invention, friction has been reduced by eliminating some yarn contacting surfaces and by limiting the length of engagement of the warp strands with other surfaces. This has resulted in a simplification of the weaving machine and a reduction in its cost. Threading of the machine causes fewer problems. Drop wires may again be used.

DESCRIPTION OF THE PREFERRED EMBODIMENT

Figure 1:
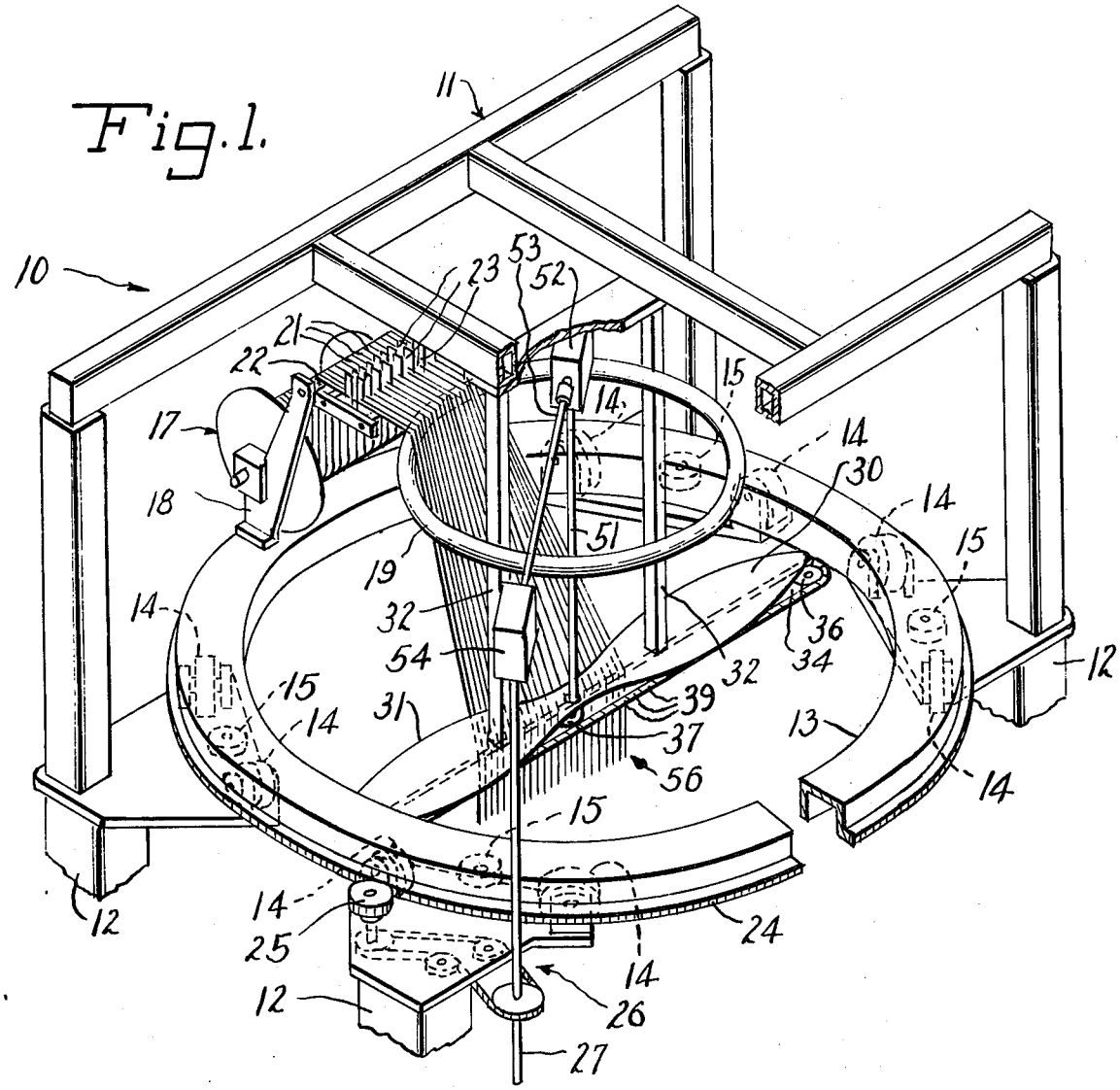
FIG. 1 is a perspective view, partially in section, of the warp supply portion of a triaxial weaving machine.

As seen in FIG. 1, the warp supply module 10, or equivalent portion, of a triaxial weaving machine comprises a frame 11 having a plurality of legs 12, which support the warp supply module above a weaving module (not shown). An annular channel 13 is mounted upon support rollers 14 for rotation in a horizontal plane and is guided in a fixed path by guide rollers 15. A plurality of warp beams 17 (only one being shown for clarity) are mounted for rotation on brackets 18 in spaced relation upon the annular channel 13 to form a creel. A generally circular guide, or yarn ring, 19 is also shown as mounted rigidly and concentric with the annular channel on the brackets 18. A plurality of ends 21 of yarn on each of the beams 17 pass over a whip roll 22 and through the ring 19. Between the whip roll and the ring, the yarn lies in a substantially horizontal plane and each of the ends supports a conventional drop wire 23. The periphery of the annular channel is provided with teeth 24 whereby the channel and all of the components mounted thereon may be rotated by a driving gear 25 in engagement with the teeth. The gear is driven by a chain and sprocket drive 26 from a drive shaft 27, which is coupled to the weaving mechanism (not shown) such that the channel makes one revolution for each completion of a traverse by a heddle, as a result of weftwise shifting and row-to-row transferring, from an initial position back to the same position. For more information about heddle shifting and transferring in a triaxial weaving machine, reference is made to U.S. Pat. Nos. 3,999,578, issued on Dec. 28, 1976 Karol Kulczycki; 4,013,103, issued on Mar. 22, 1977 to Karol Kulczycki and Burns Darsie; and 3,985,159, issued on Oct. 12, 1976 to Franklin L. Townsend and Frank P. Trumpio. For more information on modular triaxial weaving machines, reference is made to U.S. Pat. No. 4,105,052, issued on Aug. 8, 1978 to Wayne C. Trost and Burns Darsie.

Figure 2:
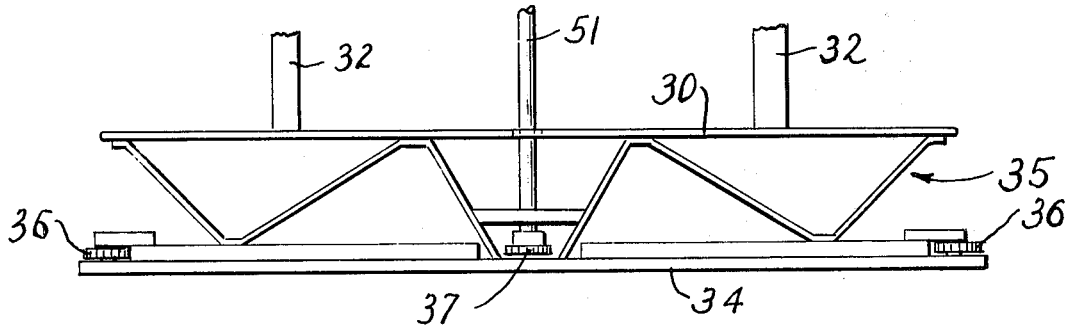
FIG. 2 is an elevation showing the track suspension.
Figure 3:
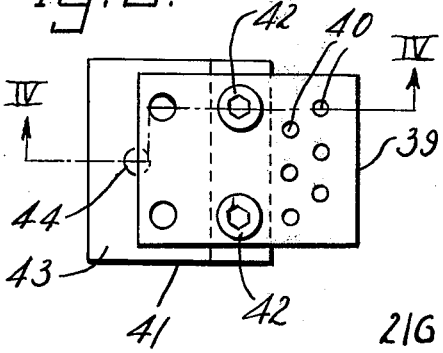
FIG. 3 is a plan view of a block connected to the overhanging outer link of a roller chain.
Figure 4:
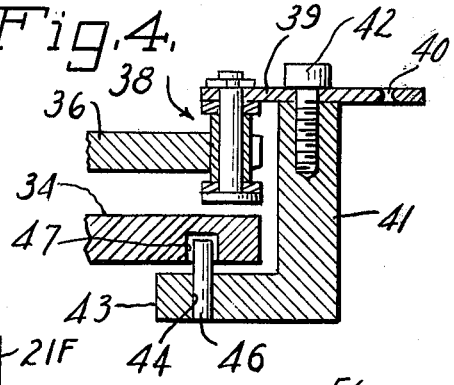
FIG. 4 is a sectional view of the block, substantially along line IV—IV in FIG. 3, and its relation to the track.
Figure 5:
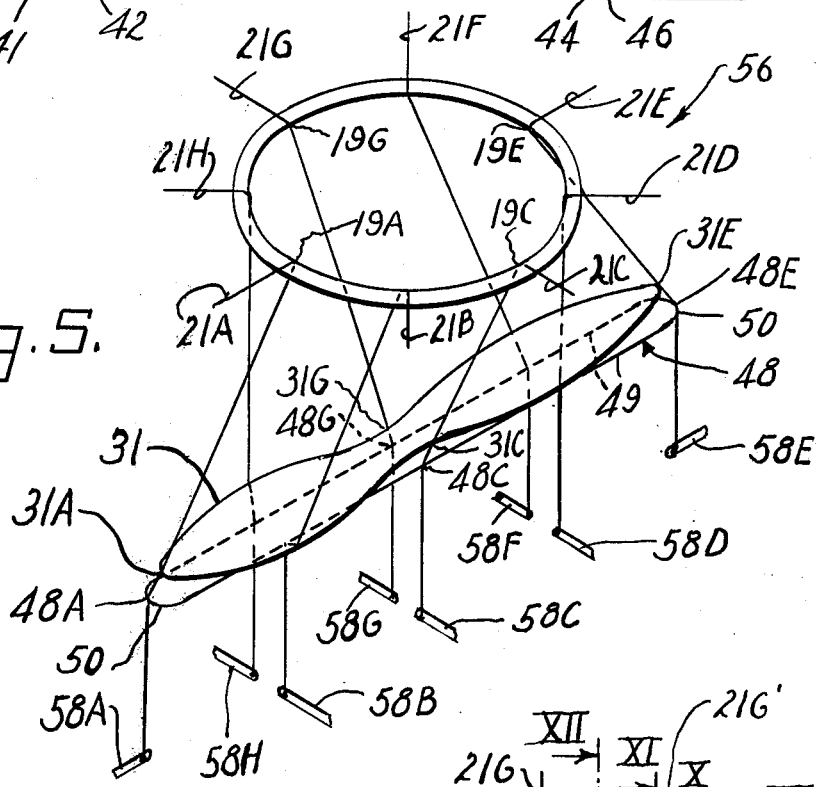
FIG. 5 is a perspective line drawing showing typical paths followed by yarn in passing through the warp length compensator.

A cam 30 having a smoothly continuous yarn-deflecting surface 31 is rigidly suspended from the frame 11 by hangers 32. An elongated member 34 is rigidly suspended and spaced from the cam by a truss-like suspension 35, as seen in FIG. 2. At each end of the member is a freely rotating sprocket 36, and intermediate the ends is a driving sprocket 37. The purpose of these sprockets is to guide and drive an endless roller chain 38, seen in section in FIG. 4, around the member. The outer links 39 on the upper side of the roller chain extend outwardly from the member in substantially side-by-side relation. Each outer link, as shown in FIGS. 3 and 4, has at least one passageway, shown as enclosed, therethrough forming a yarn separator 40 for receiving and guiding at least one end 21 of yarn from the yarn ring 19. A depending block 41 is affixed to the overhanging outer link 39 as by one or more screws 42. A portion 43 of the block underlies the member 34. A hole 44 through the underlying portion retains a guide pin 46 extending into an endless groove 47 in the underside of the member to maintain the yarn separators, while moving around the member, in a predetermined endless track 48 having elongated parallel portions 49 extending weftwise and substantially coextensive with said rows of heddles, and short connecting portions 50 joining the adjacent ends of the parallel portions, as seen in FIG. 5. The radius of the connecting portion is determined by the radius of the sprocket 36, which, along with the radius of driving sprocket 37, should be kept as small as is practical so that the parallel portions 49 may be as close together as possible, thereby reducing the difference in the length of warp strands between the yarn separators and the heddles as alternate sheds are formed. The sprocket 37 is affixed to a driven shaft 51, which is coupled to drive shaft 27 through gear box 52, jack shaft 53 and gear box 54. The gear ratios in gear boxes 52 and 54 are chosen such that a yarn separator 40 travels once around the track 48 for each revolution of the annular channel 13.

Figure 8:
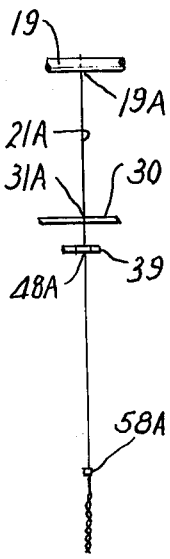
FIG. 8 is a partial end view of FIG. 7.
Figure 9:
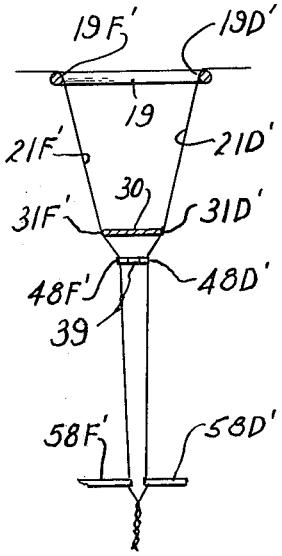
FIGS. 9-12 are projections, partially in cross-sections substantially along lines IX—IX to XII—XII in FIG. 6, of the paths followed by yarn in various positions.
Figure 10:
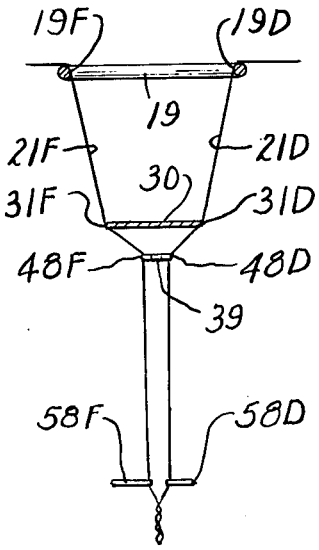
Figure 11:
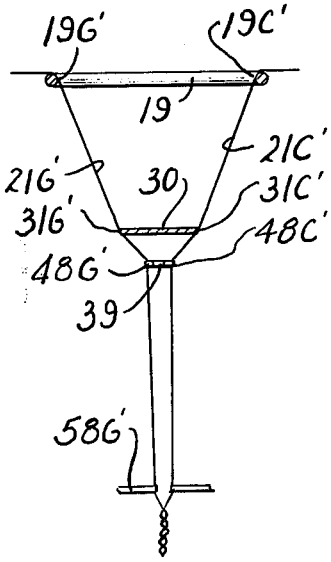
Figure 12:
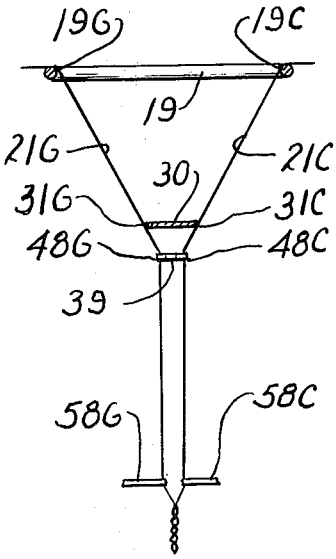

FIG. 5 shows some of the paths followed through the warp length compensator 56 by every end 21 of yarn as the annular channel 13 revolves to move the end past equally spaced positions 19A–H on the yarn ring 19. The corresponding locations of the yarn along the track 48 is identified by respective positions 48A–H. It will be noted that the end of yarn in position 21A approaches the yarn ring 19 substantially radially and in a weftwise direction, that it engages the inside of the ring at position 19A, that it contacts the yarn deflecting surface at the extreme end position 31A, and that it passes through a yarn separator 40 at end position 48A. At end position 48A the yarn passes from the warp length compensator 56 and the warp supply module 10 to a heddle 58 at transfer position 58A in the weaving module (not shown). The straight line followed between positions 19A and 48A through position 31A represents a limiting condition on the shape of the yarn-deflecting surface 31. The end in its diametrically opposite position 21E follows a similar straight line between positions 19E and 48E through position 31E to represent another limiting condition due to symmetry. Any increase in the length of cam 31 would produce a deflection of the end of yarn in these positions from the straight lines shown, thereby increasing the length of yarn between the ring 19 and the yarn separator 40. In like manner additional limits are placed upon the yarn-deflecting surface 31 by thread in positions 21C and 21G, approaching the yarn ring in diametrically opposite directions perpendicular to the weftwise approach of the end of yarn in positions 21A and 21E. In following straight lines from points 19C, 19G to mid-positions 48C, 48G, the end of yarn in positions 21C and 21G contacts mid-positions 31C and 31G, respectively. Any increase in the width of cam 31 between the mid-positions 31C and 31G would produce a deflection of the end of yarn in positions 21C and 21G from the straight lines shown, thereby increasing the length of yarn between the ring 19 and the yarn separator 40. Because the yarn ring 19 has an inner diameter chosen as substantially half of the distance between end points 48A and 48E, the lengths of the end in each of positions 21A, 21C, 21E and 21G are substantially equal between yarn ring 19 and track 48. The shape of yarn-deflecting path 31 between these established points 31A, 31C, 31E and 31G is then selected such that the end of yarn in other than those positions described above is deflected from a straight line between its point of contact with the yarn ring 19 and its yarn separator 41 on track 48 to maintain a constant length of yarn between the yarn ring and the track. The shape of the yarn-deflecting surface 31 established in this manner turns out to be what may best be described as that of the outer periphery of an elongated figure 8, as seen in plan in FIG. 6. In order to assure that the yarn-deflecting surface 31 presents a continuous smooth surface without cusps to the end of yarn, the cam 30 can be enlarged somewhat, so that the end of yarn is always deflected to some extent from a straight line between the yarn ring and the track, but always to such an extent that the length of yarn between the yarn ring and the track is maintained constant. The timed relation of movement of the creel and yarn separators with respect to the shifting and transfer of the heddles is such that an end of yarn 21, initially at position 21A, approaches the yarn ring 19 in a weftwise direction and passes in a single plane through the ring at position 19A, over the yarn-deflecting surface at the extreme end position 31A, through a yarn separator 40 at position 48A at the extreme end of the track 48, to a heddle at position 58A midway through its transfer from one row of heddles to the other. As the end of yarn 21 moves at a substantially constant speed through positions 21B–H and back to 21A, it also is moved at a substantially constant speed around the track 48 through positions 48B–H back to 48A, and is moved intermittently by the shifting and transfer of its respective heddle 58 at a substantially constant average speed from position 58A down one row of heddles through positions 58B–D to transfer position 58E and then back down the other row of heddles through positions 58F–H back to position 58A. The lateral movement of the end of yarn 21 is always in the same direction, shown as counter-clockwise from the top. The rotation of the drive shaft 27 is in timed relation to the shifting and transfer of the heddles 58 in the weaving module (not shown) so that the length of the end of yarn 21 between the yarn separator 40 and heddle 58 remains constant throughout its lateral travel.

Figure 6:
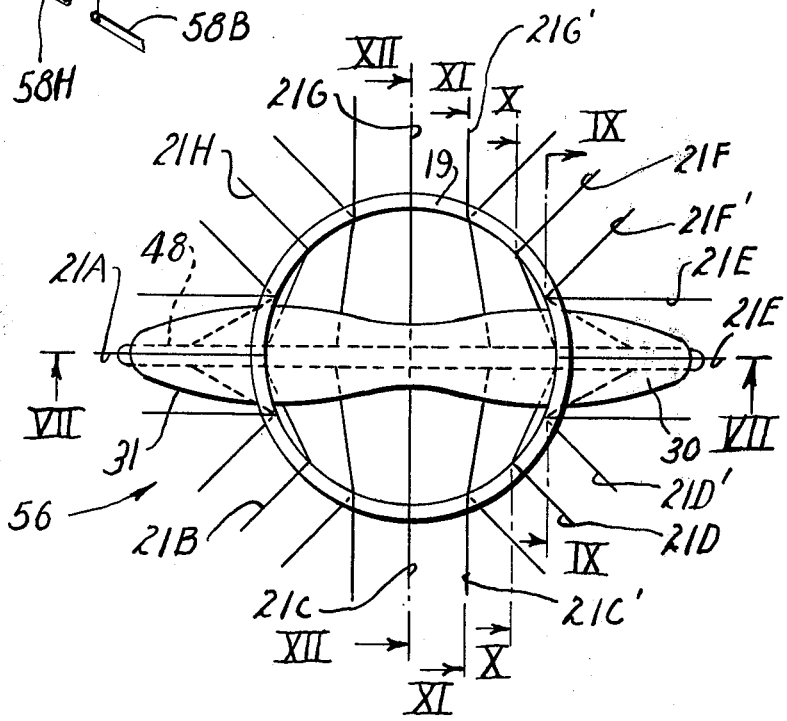
FIG. 6 is a plan view of the warp length compensator with selected ends of yarn passing therethrough.
Figure 7:
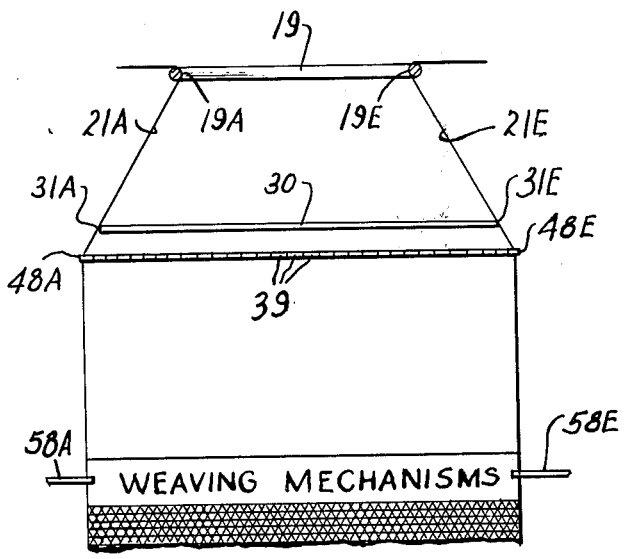
FIG. 7 is a cross-sectional elevation taken substantially along line VII—VII in FIG. 6.

FIG. 6 is a plan view of the warp length compensator 56 of FIG. 5, in which the end of yarn 21 in the positions 21A–H is assumed to come from the middle of warp beam 17 as it is rotated past equally spaced positions equal in number to the number of beams on the channel 13. The ends of yarn from any one beam lie substantially parallel to each other as they approach the yarn ring 19. The ends of yarn from adjacent ends of adjacent beams lie side-by-side on ring 19, so that the ends of yarn 21 are evenly distributed around the ring. Ends 21E and 21F' of yarn are representative of yarn coming from adjacent ends of adjacent warp beams. Other ends of yarn from ends of warp beams, and the positions associated with them, are similarly identified by primes (') in FIGS. 6, 9 and 11. FIGS. 7–12 show projections of representative paths of yarn through the warp length compensator. They are believed to be self-explanatory.

The preferred embodiment shown and described is only exemplary of the invention. Substitutions and modifications will be obvious to those skilled in the art. The invention is defined by the claims.

I claim:

1. A warp length compensator in a weaving machine having a pair of opposed parallel weftwise rows of heddles for guiding warp strands arranged in two sheets to form alternate warp sheds, the heddles in said opposed rows of heddles being shifted weftwise in opposite directions such that the warp strands in one of said sheets cross the warp strands in the other of said sheets, the leading heddle in each of said opposed row of heddles being transferred to the trailing position in the other of said rows of heddles, a creel supplying ends of yarn, and means for rotating said creel about an axis perpendicular to said rows of heddles in the direction of and in timed relation to the shifting and transferring of said heddles, said compensator comprising a yarn ring parallel to and concentric with said creel for guiding therethrough an end of yarn passing from the creel and, as a warp strand, to a respective one of said heddles, a fixed track intermediate the yarn ring and said rows of heddles, parallel portions of said track extending weftwise substantially coextensive with said rows of heddles, short connecting portions of said track joining the adjacent ends of said parallel portions, a movable yarn separator for guiding said yarn end, means for moving said yarn separator around said track in timed relation to the shifting and transferring of said one of said heddles, and a fixed cam for deflecting the end of yarn intermediate the yarn ring and said yarn separator such as to maintain a fixed length of said yarn end between the yarn ring and said yarn separator.

2. A compensator according to claim 1 wherein the yarn-deflecting surface of said cam is continuous.

3. A compensator according to claim 2 wherein the shape of said yarn-deflecting surface approximates that of the outer periphery of an elongated figure 8.

4. A compensator according to claim 1 wherein the inner diameter of said yarn ring is approximately half the length of said track.

5. A compensator according to claim 4 wherein the size of said yarn-deflecting surface is such that said end of yarn near the middle of the parallel portions and near the middle of the connecting portions of said track follows substantially straight lines between the yarn ring and said yarn separator.

6. A compensator according to claim 1 wherein said yarn separator guides a plurality of adjacent yarn ends passing from the creel to respective adjacent ones of said heddles.

7. A compensator according to claim 1 wherein a plurality of yarn separators are movable as a single unit.

8. A compensator according to claim 7 wherein said block comprises a plurality of enclosed passageways therethrough serving as said yarn separators.

9. A compensator according to claim 1 wherein a plurality of yarn separators are coupled to form an endless line of yarn separators extending around said track.

* * * * *